US012655833B2

(12) United States Patent
Afshar et al.

(10) Patent No.: US 12,655,833 B2
(45) Date of Patent: Jun. 16, 2026

(54) SYSTEM ADN METHOD FOR MONITORING THE OIL LEVEL OF AN OIL-LUBRICATED COMPRESSOR

(71) Applicant: KNORR-BREMSE SYSTEME FÜR SCHIENENFAHRZEUGE GMBH, Munich (DE)

(72) Inventors: Ehsan Afshar, Munich (DE); Stefan Lange Stefan Lange, Munich (DE); Adrian Kramlich, Munich (DE); Rainer Stromayr, Germering (DE); Michael Kramer, Munich (DE)

(73) Assignee: KNORR-BREMSE SYSTEME FÜR SCHIENENFAHRZEUGE GMBH (DE)

( * ) Notice: Subject to any disclaimer, the term of this patent is extended or adjusted under 35 U.S.C. 154(b) by 280 days.

(21) Appl. No.: 18/028,993

(22) PCT Filed: Sep. 2, 2021

(86) PCT No.: PCT/EP2021/074306
§ 371 (c)(1),
(2) Date: Mar. 28, 2023

(87) PCT Pub. No.: WO2022/069147
PCT Pub. Date: Apr. 7, 2022

(65) Prior Publication Data

US 2024/0200545 A1 Jun. 20, 2024

(30) Foreign Application Priority Data

Sep. 30, 2020 (DE) ..... 10 2020 125 500.4

(51) Int. Cl.
*F04B 39/02* (2006.01)
*F04B 49/02* (2006.01)

(52) U.S. Cl.
CPC ..... *F04B 39/02* (2013.01); *F04B 49/02* (2013.01); *F04B 2201/0404* (2013.01)

(58) Field of Classification Search
CPC .. F04B 2201/0404; F04B 39/02; F04B 53/18; F04C 15/0088; F04C 29/02–021; F04C 2270/24; F04C 2210/14; F04D 29/06
See application file for complete search history.

(56) References Cited

U.S. PATENT DOCUMENTS 3,696,758 A 10/1972 Godinez, Jr.
4,798,082 A * 1/1989 Fujikawa ..... F02B 63/04 439/219

(Continued)

FOREIGN PATENT DOCUMENTS

CN 101191477 A 6/2008
CN 107738640 A 2/2018

(Continued)

OTHER PUBLICATIONS

International Search Report corresponding to PCT/EP2021/074306 dated Nov. 23, 2021.

(Continued)

*Primary Examiner* — Thomas Fink
(74) *Attorney, Agent, or Firm* — Barnes & Thornburg LLP

(57) ABSTRACT

A method for monitoring an oil level of an oil-lubricated compressor, the method including: reading at least one oil level sensor, by which an oil level representing the compressor oil level is detected; checking compliance with at least one predetermined verification criterion for verification of the read-out oil level; and relaying an oil level signal if the read-out oil level complies with at least one relaying crite- (Continued)

rion according to whether the oil level reaches or falls below a predetermined oil level and with the at least one verification criterion.

15 Claims, 3 Drawing Sheets

(56) References Cited

U.S. PATENT DOCUMENTS

| | | | | |
|---|---|---|---|---|
| 4,990,057 | A | 2/1991 | Rollins | |
| 5,634,345 | A | 6/1997 | Alsenz | |
| 5,901,559 | A | 5/1999 | Westermeyer et al. | |
| 7,498,932 | B1 * | 3/2009 | Steffen | F01M 1/18 123/196 R |
| 2008/0154477 | A1 * | 6/2008 | Yokoi | F01M 1/18 701/101 |
| 2016/0210793 | A1 * | 7/2016 | Staley | G07C 5/006 |
| 2020/0235533 | A1 * | 7/2020 | Oakes | B60R 16/0207 |
| 2022/0268185 | A1 * | 8/2022 | Dewhurst | F01M 11/0408 |

FOREIGN PATENT DOCUMENTS

| | | | | |
|---|---|---|---|---|
| CN | 209083504 | U | 7/2019 | |
| DE | 10044916 | A1 | 3/2002 | |
| DE | 202004014254 | U1 | 11/2004 | |
| EP | 1900912 | A2 | 3/2008 | |
| JP | H10942788 | A | 2/1997 | |
| JP | 2004150374 | A | 5/2004 | |
| JP | 2008057476 | A | 3/2008 | |
| JP | 2016118317 | A | 6/2016 | |
| RU | 151469 | U1 | 4/2015 | |
| RU | 2562693 | C2 | 9/2015 | |
| RU | 178890 | U1 | 4/2018 | |
| RU | 2697293 | C2 | 8/2019 | |
| WO | WO-2014189440 | A1 * | 11/2014 | G01M 3/26 |

OTHER PUBLICATIONS

Chinese Search Report corresponding to Application 202180066780.8 Jun. 12, 2025.

* cited by examiner

SYSTEM ADN METHOD FOR MONITORING THE OIL LEVEL OF AN OIL-LUBRICATED COMPRESSOR

PRIORITY

This patent application is a U.S. National Phase of International Patent Application No. PCT/EP2021/074306 filed Sep. 2, 2021, which claims priority to German Patent Application No. 10 2020 125 500.4, the disclosure of which being incorporated herein by reference in their entireties.

FIELD

Disclosed embodiments relate to a method for monitoring the oil level of an oil-lubricated compressor, an oil level monitoring system for carrying out the method and a compressor system having such an oil level monitoring system.

BACKGROUND

By way of example, the oil level of oil-lubricated compressors for rail vehicles is manually checked on a regular basis at present in order to prevent consequential damage and/or breakdowns owing to an insufficient oil level. This is associated with a corresponding amount of maintenance effort and, in particular in the event of an unexpected loss of oil outside the maintenance intervals, can result in compressor damage due to attendant overheating. In principle, a manual check on the oil level is also susceptible to error, however, since readings are sometimes taken incorrectly or even inadvertently not at all. Reading errors can also be promoted as a result of the specific process for reading the oil level, such as warming up the compressor, parking, observing a waiting period and only then taking the reading, not being observed. The oil level indicator provided for reading is generally an inspection glass or inspection tube on the oil container with a certain display level. This too can result in possible reading errors due to individual viewing angles or accessibilities.

SUMMARY

In view of the explanations above, the disclosed embodiments provide a method for monitoring the oil level of an oil-lubricated compressor, an oil level monitoring system for carrying out the method and a compressor system having such an oil level monitoring system, in order to facilitate inexpensive automated and reliable oil level monitoring.

BRIEF DESCRIPTION OF THE FIGURES

Disclosed embodiments are explained in more detail hereinafter on the basis of the accompanying figures, in which, specifically.

DETAILED DESCRIPTION

Figure 1:
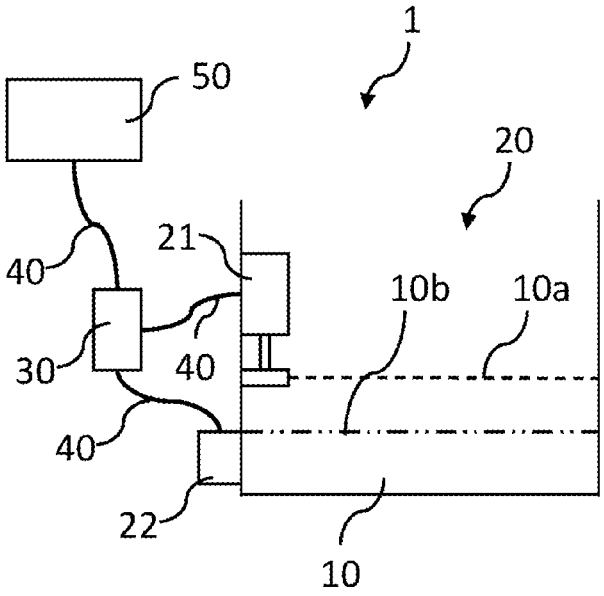
FIG. 1 shows a schematic representation of an oil level monitoring system according to an exemplary embodiment.

According to disclosed embodiments, a method for monitoring the oil level of an oil-lubricated compressor may include reading at least one oil level sensor that is used to detect an oil level representing the compressor oil level, testing whether at least one predefined verification criterion for verifying the read oil level is satisfied, and relaying an oil level signal if the read oil level satisfies at least one relay criterion according to a predetermined oil level being reached or dropped below and the at least one verification criterion.

An oil level representing the compressor oil level may be an oil level of the compressor itself or an oil level that corresponds to the oil level of the compressor. By way of example, a proportion of the oil can be discharged from the compressor for the purpose of monitoring the oil level, in order to facilitate detection that is independent of compressor operation and/or design parameters.

The oil level can be detected by both the analog and digital routes. Analog oil level detection is understood to mean quantitative detection, that is to say, for example, determining a specific fill level or a fill volume. By contrast, digital detection only ever allows determination of whether a qualitative oil level feature, such as compliance with a minimum oil level, is fulfilled.

The test on at least one verification criterion is used to verify the read oil level. The verification criterion is used not to assess the read oil level per se, but rather to assess the suitability of the read oil level for relaying an oil level signal, provided that an accordingly predetermined relay criterion is satisfied. The relay criterion, accordingly, corresponds to the information content of the oil level signal that is to be relayed, whereas the verification criterion verifies the applicability of the information or at least the sufficient probability thereof.

According to the method of the disclosed embodiments, the relaying of an oil level signal is, therefore, contingent on the satisfaction of both the at least one verification criterion and the relay criterion according to a predetermined oil level being reached or dropped below. The oil level signal initially needs to be distinguished from the read signal from the oil level sensor, that is to say the sensor signal. If the oil level signal does not need to contain any information other than the sensor signal, for example, because the sensor signal can be directly processed as an oil level signal when relayed, the oil level signal is equivalent to the sensor signal. In many cases, however, it may be advantageous if not the sensor information per se but rather information derived therefrom is relayed as the oil level signal. In such a case, the content of the oil level signal differs from the content of the sensor signal. The sensor signal can, accordingly, be converted into an oil level signal.

The method can be advantageously used in particular for oil-lubricated compressors for rail vehicles.

In accordance with disclosed embodiments of the method, the relay criterion is equivalent to a low oil level and/or a critical oil level. When the oil level is low, the compressor can still continue to be operated for a certain operating period without the likelihood of compressor damage as a result of overheating, for example. Relaying an appropriate oil level signal, accordingly, allows replenishment of oil to be scheduled within the still tolerable operating period. When the oil level is critical, consequential damage can no longer be ruled out if the compressor continues to be operated, and so it is advisable for compressor operation to be suspended. Therefore, not only may a distinction be drawn between a low oil level and a critical oil level, but rather, in particular, different oil level signals are, accordingly, also relayed.

In particular, the verification criterion is equivalent to at least one time criterion, involving the oil level that meets the relay criterion being read over a predetermined period of time, a recurrence criterion, involving there being a predetermined number of individual reading operations that satisfy the relay criterion, and/or an operating state criterion, involving a predetermined operating state being ascertained.

As already explained above, the at least one verification criterion is used to test the suitability of the oil level signal for relaying when the relay criterion is satisfied. By way of example, an oil level equivalent to the relay criterion may occur only for a short time and may be attributable not to the actual oil level, but rather to a vibration in the oil reservoir or to other circumstances not related to the oil level. To reduce the likelihood of incorrect conclusions about the actual oil level being drawn owing to temporary variations in the oil level, a time criterion can be used as a verification criterion, for example. To satisfy the time criterion, a test is performed to determine whether the oil level equivalent to the relay criterion is read consistently or at least with a predetermined recurrence over a predetermined period of time.

Alternatively or additionally, the verification criterion taken into account may also be a recurrence criterion, involving there being a predetermined number of individual reading operations that satisfy the relay criterion. A reading operation is equivalent to the at least one oil level sensor being read over a predetermined period of time. A reading operation that satisfies the relay criterion exists if the oil level equivalent to the relay criterion is read consistently or at least with a predetermined recurrence over the individual reading operation. In other words, the recurrence criterion is equivalent to a predetermined number of satisfied time criteria. To satisfy the recurrence criterion, there can be provision for the predetermined number of reading operations that satisfy the relay criterion, for example, five reading operations, to have to be directly successive or to have to be within a predetermined period of time.

As a further alternative or addition, the verification criterion defined may also be an operating state criterion, involving a predetermined operating state being ascertained. Accordingly, a test is performed to determine whether the compressor is in a predetermined operating state while the at least one oil level sensor is read. By way of example, the operating state criterion is deemed to be satisfied only if the compressor is being operated or is stopped. If operation of the compressor is required as an operating state criterion, a particular power level of the compressor operation may also be additionally required. Since ramp-up phases need to be taken into account when the compressor is being operated, or slowing phases need to be taken into account when the compressor is being stopped, it may also be advantageous to take account of not only the operating state per se but also an applicable time component for robustly reaching the operating state when defining the operating state criterion, for example, "Compressor has been running for . . . seconds" or "Compressor has been stopped for . . . seconds".

The likelihood of a reliable measurement of the oil level can be increased by combining the different verification criteria.

In one implementation of the disclosed embodiments, the predetermined operating state is ascertained by reading a pressure sensor. The predetermined operating state may be equivalent to a defined pressure window, the presence of which is determined using the pressure sensor. The term "pressure window" is focused on a pressure range that is equivalent to a depressurized or reduced-pressure state of the compressor after a predetermined time. Checking the pressure sensor makes it possible, for example, to ensure that the oil level is detected by the at least one oil level sensor in a warm, but switched-off, state of the compressor, with operation being no longer than a defined period in the past.

According to at least one embodiment, the operation of reading the at least one oil level sensor is performed before the test on the at least one predefined verification criterion. Accordingly, the test on the at least one predefined verification criterion is not carried out until the result of reading the oil level sensor is that the relay criterion is satisfied. Data determination and processing can, therefore, be reduced to a minimum.

Alternatively, however, the test on the at least one predefined verification criterion can also precede the reading of the oil level sensor. If, for example, the operating state criterion is used as a verification criterion, an oil level signal cannot be relayed until the predetermined operating state is reached anyway. Accordingly, reading the oil level beforehand, at least in accordance with the method described here, may not lead to a usable result in every method embodiment.

When multiple verification criteria are tested, the operating state criterion can also be tested first, for example, the oil level sensor can be read when the applicable operating state criterion is available, and the test on a further verification criterion, such as the time criterion, can be contingent on the relay criterion being satisfied. A verification criterion and/or an order of the method operations can also be selected on the basis of the operating state. It is, therefore, possible for different verification criteria and/or the order of the method operations, but also relay criteria, to be defined both during operation of the compressor and when the compressor is off, in order to be able to carry out tailored and, therefore, complete oil level monitoring in any operating state.

In accordance with at least one embodiment, two oil level sensors are read.

It may be advantageous to read at least two oil level sensors, for example, if multiple oil levels define a relay criterion or different relay criteria, the multiple oil levels not being able to be detected using one oil level sensor, or a detection is intended to be reproduced redundantly. If, for example, both a low oil level and a critical oil level necessitate the relaying of a or a respective oil level signal when the verification criterion to be applied is, accordingly, additionally satisfied, an oil level sensor can be used for each of the respective oil levels. In addition to using an additional oil level sensor when an additional oil level detection cannot be covered using one oil level sensor, an independent detection can also be used to adjust different detection parameters, such as measurement sensitivity, reaction times, measurement principles and the like, according to need.

In particular, the oil level sensor used is a float.

A float, or a functional unit interacting therewith, such as, for example, a float switch that can be operated by a float, affords an inexpensive implementation of an oil level monitoring system. Particularly, the inclusion of at least one verification criterion relating to oil level monitoring improves the reliability of the use of a float, which is otherwise usually subject to considerable uncertainties.

In one development, the relay criterion is taken as a basis for relaying the oil level signal as a report to a monitoring unit, in particular to a driver's cab and/or a control and/or maintenance device, and/or as a control parameter for a control apparatus of the compressor, in particular in the case of a critical oil level.

The oil level signal can use the monitoring unit to trigger a visual, audible and/or tactile signal for the purposes of a report. By way of example, a display in the driver's cab is used to display an explicit text message, such as "Oil level low" or "Oil level critical", to operating personnel and/or an appropriate warning lamp is activated. Particularly in critical situations, such as a critical oil level, it is alternatively or additionally possible for an audible signal to be output in order to increase the likelihood of detection irrespective of a line of sight. The monitoring unit may also be part of a maintenance system, as a result of which the relayed oil level signal is taken as a basis for adjusting a maintenance interval and/or storing an appropriate maintenance instruction, such as, for example, "Replenish oil", in the maintenance log for the next maintenance.

However, the relay criterion for the oil level signal can also be taken as a basis for adjusting a control parameter for a control apparatus of the compressor in such a way that the likelihood of a malfunction, or of consequential damage, due to overheating of the compressor or of other consequences of a lack of oil is reduced. By way of example, the maximum compressor power can be reduced in order to ensure that the oil still remaining allows temporary emergency operation. When oil levels are critical, there may also be provision for compressor operation to be stopped completely.

According to one embodiment, the method is carried out while the oil-lubricated compressor is stopped.

This allows the stable, in particular constant, conditions required for reliably detecting the oil level to be encountered. If, as described above, there should be provision for compressor operation to be stopped when an applicable oil level signal is relayed, starting of the compressor can then be suspended. The compressor is, therefore, not switched off while operating. In other words, the compressor is started only if no oil level signals are being relayed. This can be provided as a relay criterion in particular for a critical oil level.

Additionally, it will be observed in this regard that the relay criteria, for example, a low oil level or critical oil level, can be adjusted to suit framework criteria. If, for example, a navigation system is used to base the oil level monitoring on a comparatively long route or a comparatively long time before the next maintenance interval is stored, then a higher oil level may already form a relay criterion than in the case of a comparatively short distance or short time before the next maintenance interval.

In a further aspect, the disclosed embodiments relate to an oil level monitoring system for carrying out the above method including at least one oil level sensor for detecting an oil level, representing the compressor oil level, of an oil in an oil reservoir of a compressor, and an evaluation unit for reading the sensor signals from the at least one oil level sensor, which unit stores at least one relay criterion and at least one verification criterion, wherein the evaluation unit is configured to relay an oil level signal in response to the at least one relay criterion according to the read oil level and the at least one verification criterion being satisfied.

The test to determine whether the verification criterion is satisfied is performed using the evaluation unit itself, for example, by evaluating the read oil level according to the previously described time criterion and/or recurrence criterion and, accordingly, comparing the evaluation result against the stored verification criterion. Such an evaluation result or an operating state with respect to an operating state criterion can also be transmitted to the evaluation unit for comparison against the stored values and/or states, however.

In one development, the oil level monitoring system comprises a pressure sensor, in particular a pressure sensor that can be arranged on an oil reservoir representing a compressor oil level, which sensor can be used to detect a pressure representing an operating state of a compressor, and the evaluation unit takes account of at least the detected pressure as a verification criterion.

Detecting a pressure representing the operating state of the compressor, and taking account of said pressure as a verification criterion, go hand in hand with the approach described in respect of the method. For this purpose, the pressure sensor may be arranged on an oil reservoir representing a compressor oil level, in order to be able to minimize distance-related interfering influences. The oil level in the oil reservoir corresponds to an oil level in the compressor. This condition is satisfied, for example, if the oil reservoir is an oil reservoir of the compressor or the oil level of the oil reservoir is connected with the compressor in such a way that the oil level of the oil reservoir can be used to provide statements about the oil level of the compressor. Accordingly, the expression "the oil reservoir representing the compressor oil level" is used in regard to the oil reservoir.

In particular, the at least one oil level sensor is a float.

The advantages of a float as an oil level sensor are evident analogously to the explanations already provided in relation to the method.

According to at least one embodiment, the evaluation unit is configured in such a way that it distinguishes between at least two relay criteria and takes the relay criteria as a basis for relaying different oil level signals.

By way of example, a first limit value relating to the oil level, which corresponds to a low oil level, being reached or dropped below is defined as a first relay criterion. A second limit value relating to the oil level, which corresponds to a critical oil level, being reached or dropped below is defined as a second relay criterion. The second limit value is lower than the first limit value. The first limit value being reached or dropped below and the at least one verification criterion associated with the first relay criterion being satisfied result in the evaluation unit, for example, relaying the oil level signal "Oil level low" as the applicable report to a driver's cab of a rail vehicle as an application example and/or to a maintenance device. If the read oil level reaches or drops below the second limit value while at the same time the verification criterion respectively associated with the second limit value is satisfied, the evaluation unit, for example, relays the oil level signal "Oil level critical" as the applicable report to the driver's cab of the rail vehicle and/or to a maintenance device.

Alternatively or additionally, the evaluation unit can also relay the oil level signal as a control parameter to a control apparatus of the compressor, with the result that the power of the compressor can be reduced as a precaution or operation of the compressor can be stopped entirely.

Disclosed embodiments also relate to a compressor system having an oil level monitoring system as above, the compressor system comprising an oil reservoir representing a compressor oil level, and the at least one oil level sensor being arranged, in particular centrally, in the oil reservoir.

The positioning of the oil level sensor influences the likelihood of detection of a temporary variation in the oil level that is in the oil reservoir compared to an actual oil level. If a float is arranged at one edge of the oil reservoir as an oil level sensor, for example, variation in the oil level according to a fluid movement at the edge of the oil reservoir gives rise to greater amplitudes and, therefore, greater uncertainties when distinguishing between temporary level movements and the actual oil level. Accordingly, possible distinction uncertainties can be lessened by way of an arrangement that is as central as possible, that is to say an arrangement in a region with comparatively little level movement, or level variation amplitude. Consequently, this also allows the at least one verification criterion to be reduced to lower requirements.

Alternatively or additionally, the oil reservoir may also be in the form of a container that is largely decoupled from variations, however, in order to keep down unwanted influences on the oil level detection. In order to have to implement such variation decoupling for the compressor, there can be provision, especially here, for the oil level detection to be performed using a separate oil reservoir. The separate oil reservoir, the oil level of which corresponds to a compressor oil level, can, as a smaller unit, be decoupled from variations with less effort.

In one implementation of the disclosed embodiments, the compressor system comprises a control apparatus to which the oil level signal is relayed by way of the evaluation unit, the control apparatus controlling the operation of the compressor on the basis of the oil level signal.

As already explained with regard to the method and with regard to the oil level monitoring system, the compressor can, therefore, be controlled on the basis of the oil level signal, for example, in order to reduce oil consumption when the oil level is low or to completely prevent operation that might cause damage at such an oil level, in particular at a critical oil level. The control apparatus can, accordingly, switch the compressor to a mode with lower oil consumption or suspend operation of the compressor, for example.

Disclosed embodiments are explained in more detail hereinafter on the basis of the accompanying figures.

Figure 2:
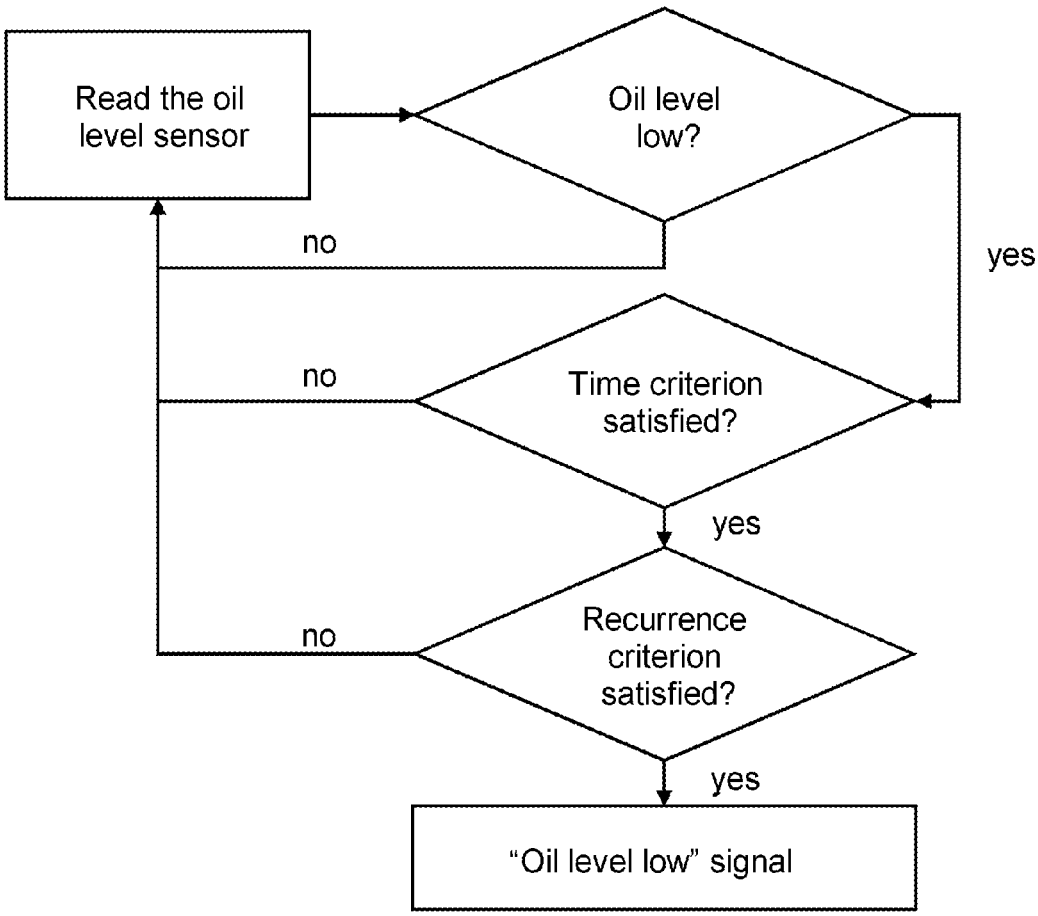
FIG. 2 shows a flowchart for a method for oil level monitoring according to a first method embodiment.
Figure 3:
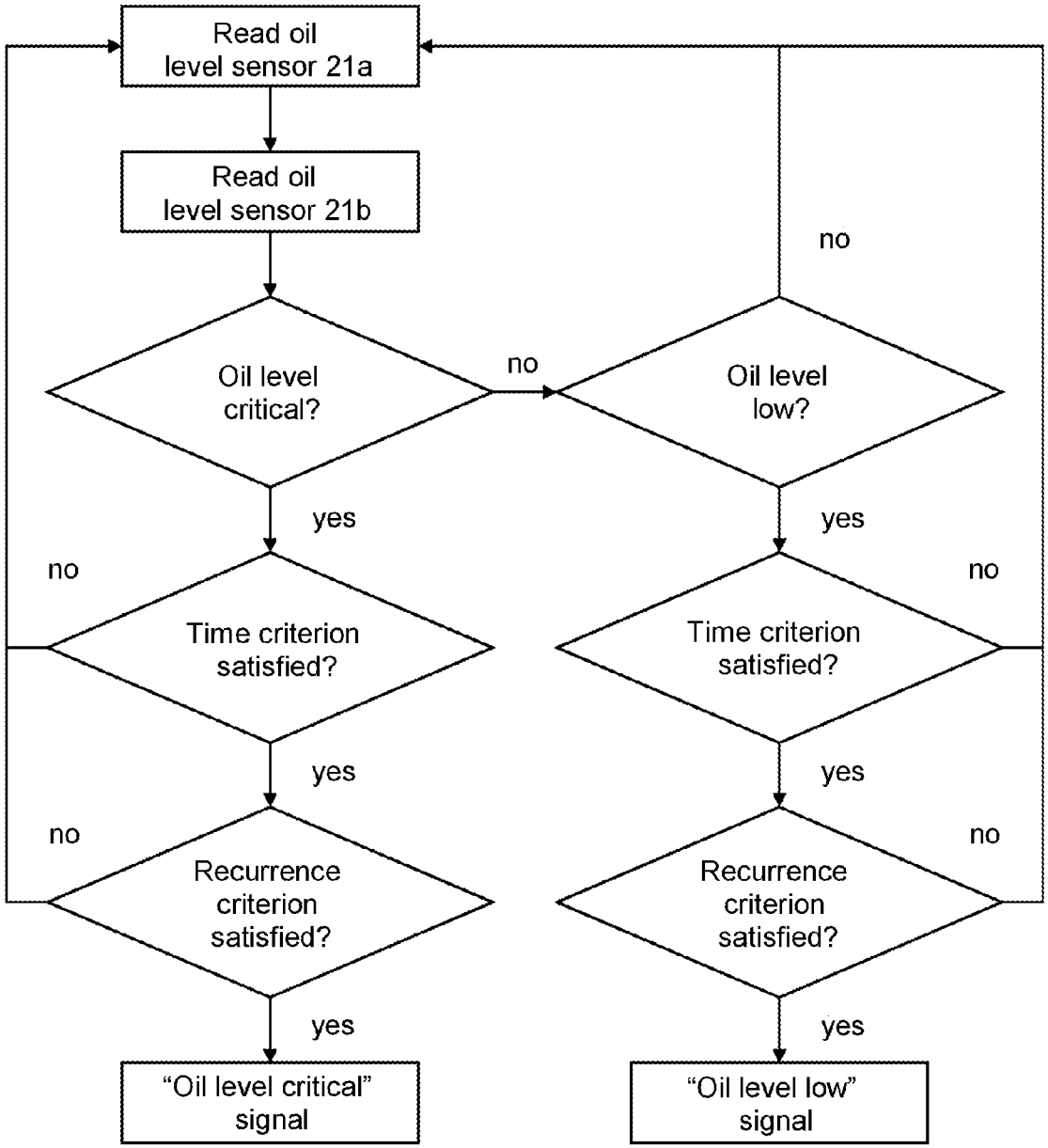
FIG. 3 shows a flowchart for a method for oil level monitoring according to a second method embodiment.
Figure 4:
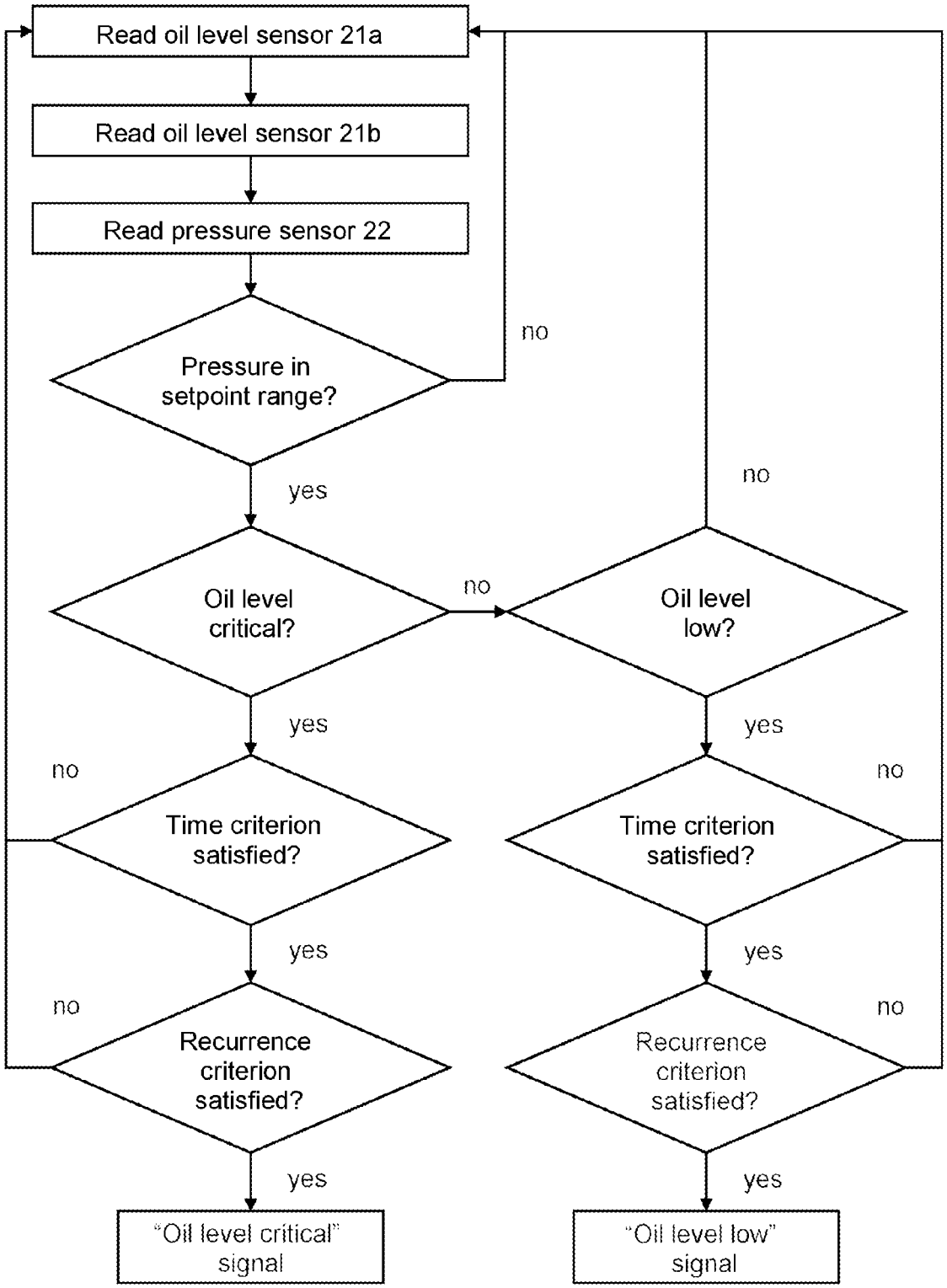
FIG. 4 shows a flowchart for a method for oil level monitoring according to a third method embodiment.

FIG. 1 shows an oil level monitoring system 1 for carrying out a method for monitoring the oil level of an oil-lubricated compressor on the basis of oil level monitoring of an oil-lubricated compressor for rail vehicles, as can also be used for the method embodiments shown in FIGS. 2 to 4. The oil level monitoring system 1 includes an oil level sensor 20 arranged in an oil reservoir 20 representing the oil level of the oil-lubricated compressor. The oil level sensor 20 is in the form of a float here. Moreover, the oil level monitoring system 1 comprises an evaluation unit 30 that is connected for signalling purposes to the oil level sensor 21 via a signal line 40. The connection for signalling purposes can also be formed using wireless types of transmission. In the embodiment shown, the evaluation unit 30 is supplied with not only the sensor signals from the oil level sensor 21 but also with sensor signals from a pressure sensor 22 arranged on the oil reservoir 20, in order to be able to use the detected pressure to derive an operating state of the compressor. Here too, the connection for signalling purposes is made via a further signal line 40, for example.

Moreover, FIG. 1 uses the dashed line to show a low oil level 10*a*. The dash-dot line 10*b* represents a critical state 10*b*. According to the representation shown for the oil level sensor 21, the oil 10 in the oil reservoir 20 has a low oil level 10*a*. When the relay criterion is defined as the low oil level 10*a* being reached or dropped below, said criterion is, accordingly, satisfied in the state shown. This is either tested by the evaluation unit 30 by comparing the sensor signal from the oil level sensor 21 against a stored limit value for the relay criterion, or an accordingly positive value for satisfaction of the relay criterion is transmitted by the oil level sensor itself. To this end, the oil level sensor can comprise a data processing unit of its own. If the oil level sensor 21 is in digital form, that is to say it only transmits a signal when the relay criterion is satisfied in any case, for example, then the presence of the sensor signal at the evaluation unit 30 can comprise sufficient information content.

Since satisfaction of the relay criterion by the read oil level does not yet have to be sufficient per se to reliably indicate the actual oil level, however, the evaluation unit 30 additionally checks a predetermined verification criterion. In the embodiment shown for the oil level monitoring system 1, the sensor signal from the pressure sensor 22 is used by the evaluation unit to detect whether the compressor is stopped, for example. Only when the pressure signal satisfying the applicable verification criterion is present while at the same time the relay criterion is satisfied by the sensor signal from the oil level sensor 21 is an oil level signal relayed to the driver's cab 50 by the evaluation unit 30 via a further signal line 40, for example, the report "Oil level low" then appears on an appropriate display apparatus in the driver's cab. As will also be clarified on the basis of the further description of the figures, the verification criterion is not limited to an operating state criterion that can be checked by the pressure sensor 21 here, but rather it can also alternatively or additionally reproduce a time criterion or recurrence criterion, for example.

FIG. 2 shows a flowchart for a method for monitoring the oil level according to a first method embodiment. In this case, the oil level sensor 21 is initially read. If the read oil level satisfies the relay criterion "Oil level low", that is to say a predetermined limit value equivalent to this relay criterion is reached or dropped below, defined verification criteria are tested for whether they are satisfied. Otherwise, the oil level sensor continues to be read. In the method embodiment shown, the reading of a low oil level initially results in a test being performed to determine whether a time criterion is satisfied. The time criterion here is consistent measurement of a low oil level, i.e. the oil level that satisfies the relay criterion, over x seconds, that is to say a predetermined period or minimum period. If the time criterion is satisfied, a recurrence criterion is tested as a further verification criterion or otherwise the evaluation is terminated and the oil level sensor again continues to be read. According to the recurrence criterion applied here, a test is performed to determine whether there is a predetermined number k of successful measurements. The evaluation unit 30 is programmed such that it recognizes instantaneous changes in the read oil level over a period of $t<x*ms$ as an oil level measurement error and does not rate them. The recurrence criterion is deemed satisfied if the oil level satisfying the relay criterion, i.e. here a low oil level, is read on the predetermined number k of occasions, for example, five times, within a predefined period of time. However, the recurrence criterion may also be defined in such a way that satisfaction thereof requires the time criterion to be met on a specific number of occasions successively or within a predetermined period of time. If the recurrence criterion is satisfied, an oil level signal "Oil level low" is relayed. According to this oil level signal, for example, a display in the driver's cab 50 is used to display an appropriate report "Oil level low". The oil level signal can alternatively or additionally also be relayed to a maintenance device, which then stores the replenishing of oil as a maintenance task in the maintenance log for the respective compressor. In one embodiment, the maintenance device can also adjust, for example, bring forward, maintenance times on the basis of the oil level signal.

FIG. 3 shows a flowchart for a method for monitoring the oil level according to a second method embodiment. The second method embodiment differs from the first method embodiment in that a distinction is drawn between two relay criteria. A first limit value relating to the oil level, which corresponds to a low oil level, being reached or dropped below is defined as a first relay criterion. A second limit value relating to the oil level, which corresponds to a critical oil level, being reached or dropped below is defined as a second relay criterion. The second limit value is lower than the first limit value. In the flowchart shown for illustrative purposes in this regard, two digital oil level sensors 21*a*, 21*b* are read. Reading the first oil level sensor 21*a* is equivalent to testing the first relay criterion, that is to say a low oil level, and reading the second oil level sensor 21*b* is equivalent to testing the second relay criterion, that is to say a critical oil level. Alternatively, however, an analog oil level sensor can also be read, which can then be used to detect both a low oil level and a critical oil level. The analog oil level sensor can thus be used instead of the oil level sensors 21*a*, 21*b*. Irrespective of the number of oil level sensors used, a test is now initially performed to determine whether there is a critical oil level, i.e. the second limit value is reached or dropped below, according to the read oil levels. If a critical oil level is not detected, the remainder of the method sequence shown in FIG. 3 is equivalent to the first method embodiment shown in FIG. 2. If a critical oil level is detected according to the read oil level from the oil level sensor 21*b*, a time criterion and a recurrence criterion are likewise tested in addition to the presence of the second relay criterion, analogously to the remainder of the method for a low oil level. In the exemplary second method embodiment, the time criteria and recurrence criteria for the relay criteria "Oil level critical" and "Oil level low" are identical except for the respective limit values and, therefore, oil levels to be used. In further method variants, the verification criteria can also be defined independently of one another, however. If the associated time criterion and recurrence criterion for a critical oil level are satisfied, an oil level signal "Oil level critical" is relayed. This signal is also relayed to the driver's cab 50 here for display, for example. Moreover, the oil level signal can also be relayed to a control apparatus of the compressor, in order to prevent further operation of the compressor or to switch to a different mode in this case.

FIG. 4 shows a flowchart for a method for monitoring the oil level according to a third method embodiment. The third method embodiment shown in FIG. 4 differs from the second method embodiment shown in FIG. 3 by virtue of the additional reading of the pressure sensor 22. The pressure to be tested is equivalent to an operating state criterion as a further verification criterion. By way of example, the setpoint range is defined as the pressure range that is present when the compressor is stopped. Only when the read pressure from the pressure sensor 22 is in the predetermined setpoint range is the oil level monitoring according to the second method embodiment continued. In other words, satisfaction of the operating state criterion is a prerequisite for further testing of the relay criteria and owing to the respective time criterion and respective recurrence criterion. If the pressure is outside the predefined setpoint range, the sensor values continue to be read until the operating state criterion equivalent to the pressure is satisfied.

Disclosed embodiments are not limited to the specific embodiments described. Even if, for example, the operating state criterion in the third method embodiment is tested on the basis of a pressure measurement by way of example, the respective operating state of the compressor can also be relayed to the evaluation unit 30 via the control apparatus of the compressor and, accordingly, evaluated. Moreover, the evaluation unit 30 may also be part of the control apparatus of the compressor.

LIST OF REFERENCE SIGNS

1 oil level monitoring system
10 oil
10*a* low oil level
10*b* critical oil level
20 oil reservoir
21, 21*a*, 21*b* oil level sensor
22 pressure sensor
30 evaluation unit
40 signal line
50 driver's cab

The invention claimed is:

1. A method for monitoring an oil level of an oil-lubricated compressor, the method comprising:

reading at least one oil level sensor that detects an oil level representing the compressor oil level;

testing whether at least one predefined verification criterion for verifying the read oil level is satisfied;

ascertaining a predetermined operating state by reading a pressure sensor; and relaying an oil level signal in response to both the read oil level satisfying at least one relay criterion indicating a predetermined oil level being reached or dropped below and satisfaction of the at least one verification criterion, wherein the verification criterion comprises each of at least a recurrence criterion involving a predetermined number of individual reading operations that satisfy the relay criterion and an operating state criterion involving the predetermined operating state.

2. The method of claim 1, wherein the relay criterion is equivalent to a low oil level and/or a critical oil level.

3. The method of claim 1, wherein the reading of the at least one oil level sensor is performed before the test on the at least one predefined verification criterion.

4. The method of claim 1, wherein the at least one level oil sensor is one of two oil level sensors that are read.

5. The method of claim 1, wherein the at least one oil level sensor is a float.

6. The method of claim 1, wherein the relaying of the oil level signal as a report to a monitoring unit is based on the relay criterion.

7. The method of claim 1, wherein the method is carried out while the oil-lubricated compressor is stopped.

8. An oil level monitoring system for carrying out a method for monitoring an oil level of an oil-lubricated compressor, the system comprising:

at least one oil level sensor for detecting an oil level, representing the compressor oil level, of an oil in an oil reservoir of a compressor;

a pressure sensor for ascertaining a predetermined operating state; and an evaluation unit for reading sensor signals from the at least one oil level sensor, which evaluation unit stores at least one relay criterion and at least one verification criterion, wherein the evaluation unit is configured to relay an oil level signal in response to both the at least one relay criterion according to the read oil level and the at least one verification criterion being satisfied, wherein the verification criterion comprises each of at least a recurrence criterion involving a predetermined number of individual reading operations that satisfy the relay criterion and an operating state criterion involving the predetermined operating state being ascertained by the pressure sensor.

9. The oil level monitoring system of claim 8, wherein the pressure sensor is arranged on an oil reservoir representing the compressor oil level, which pressure sensor being configured to detect a pressure representing the operating state of the compressor.

10. The oil level monitoring system of claim 8, wherein the at least one oil level sensor is a float.

11. The oil level monitoring system of claim 8, wherein the evaluation unit is configured to distinguish between at least two relay criteria and relay different oil level signals based on the at least two relay criteria.

12. A compressor system comprising:

the oil level monitoring system of claim 8; and an oil reservoir being monitored and being indicative of a compressor oil level, wherein the at least one oil level sensor of the oil level monitoring system is arranged centrally in the oil reservoir.

13. The compressor system of claim 12, wherein the compressor system further comprises a control apparatus to which the oil level signal is relayed by way of the evaluation unit, and wherein the control apparatus controls the operation of the compressor based on the oil level signal.

14. The method of claim 6, wherein the monitoring unit is a driver's cab and/or a control and/or maintenance device.

15. The method of claim 6, wherein the oil level signal is relayed as a control parameter for a control apparatus of the compressor, the control parameter is indicative of a critical oil level.

* * * * *